US008490816B1

(12) United States Patent
Pacheco

(10) Patent No.: US 8,490,816 B1
(45) Date of Patent: Jul. 23, 2013

(54) APPARATUS FOR INSPECTING DISCARDED ARTICLES PRIOR TO DISPOSAL

(76) Inventor: Juan M. Pacheco, Houston, TX (US)

( * ) Notice: Subject to any disclaimer, the term of this patent is extended or adjusted under 35 U.S.C. 154(b) by 175 days.

(21) Appl. No.: 12/858,694

(22) Filed: Aug. 18, 2010

(51) Int. Cl.
*B65D 43/16* (2006.01)
*B65D 43/22* (2006.01)
*B65D 51/18* (2006.01)

(52) U.S. Cl.
USPC ..... 220/254.3; 220/318; 220/825; 220/833; 232/47

(58) Field of Classification Search
USPC ..... 220/501, 254.3, 259.1, 833, 836, 220/825, 323, 835, 318, 254.6, 756; 232/47; 16/425
See application file for complete search history.

(56) References Cited

U.S. PATENT DOCUMENTS

| | | | | |
|---|---|---|---|---|
| 926,684 | A * | 6/1909 | Taylor | 220/254.2 |
| 1,420,391 | A * | 6/1922 | Sweet | 220/326 |
| 4,111,476 | A * | 9/1978 | Jacobs | 292/246 |
| 4,632,253 | A | 12/1986 | Stromgren et al. | |
| 4,649,813 | A * | 3/1987 | Kehl | 100/227 |
| 4,742,339 | A | 5/1988 | Baziuk | |
| 4,776,478 | A * | 10/1988 | Miller et al. | 220/254.5 |
| 5,137,212 | A * | 8/1992 | Fiterman et al. | 232/43.2 |
| 5,156,291 | A * | 10/1992 | Mielke | 220/254.5 |
| 5,158,199 | A * | 10/1992 | Pontius | 220/825 |
| 5,704,092 | A * | 1/1998 | Nicollet et al. | 16/425 |
| 5,797,497 | A | 8/1998 | Edwards | |
| 6,222,450 | B1 | 4/2001 | Clements | |
| 6,667,689 | B1 | 12/2003 | Steffen et al. | |
| 6,783,018 | B1 * | 8/2004 | Rondeau | 220/254.3 |
| 6,833,789 | B1 | 12/2004 | Carmen et al. | |
| 7,611,179 | B2 * | 11/2009 | Lorthioir et al. | 294/34 |
| 7,683,779 | B1 | 3/2010 | Pacheco | |
| 2004/0000904 | A1 | 1/2004 | Cotter | |
| 2006/0102639 | A1 * | 5/2006 | Lubbe | 220/825 |

* cited by examiner

*Primary Examiner* — Mickey Yu
*Assistant Examiner* — Niki Eloshway
(74) *Attorney, Agent, or Firm* — Egbert Law Offices, PLLC

(57) ABSTRACT

An apparatus for inspecting discarded items prior to disposal has a receptacle suitable for fitting on an opening of a disposal container, a tray pivotally mounted in the inner opening of the receptacle so as to be movable between a generally horizontal first position and an angularly disposed second position, a handle connected to the tray and extending radially outwardly therefrom, and a latch cooperative with the handle for fixing the tray in the first position and for releasing the tray from the first position when a lifting force is applied to the handle. The second position is suitable for allowing discarded articles to pass into the container.

15 Claims, 3 Drawing Sheets

APPARATUS FOR INSPECTING DISCARDED ARTICLES PRIOR TO DISPOSAL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to apparatus used for inspecting articles prior to disposal. More particularly, the present invention relates to apparatus for inspecting for inadvertently discarded flatware, metal articles or dishware prior to disposal. The present invention also relates to apparatus that avoids waste in the hospitality and restaurant industry by allowing workers to inspect refuse and to remove valuable articles from the refuse prior to disposal.

2. Description of Related Art Including Information Disclosed Under 37 CFR 1.97 and 37 CFR 1.98

One of the most difficult problems faced by the hospitality industry, including but not limited to restaurant operators, hotels, cruise lines, and any other business that use metal flatware, is reducing or eliminating costs associated with inadvertently discarded of kitchen equipment. Metal flatware and other metal objects, such as small containers used for sauces or dressings, are often discarded with the food scraps when the staff brings the dishes to the dishwashing area for cleaning. Valuable pieces of equipment get lost in the trash continuously. This leads to an increase in the operational costs for businesses. There is an ongoing need in the hospitality industry for a useful, reliable and convenient mechanism that can allow the staff to inspect the discarded trash and refuse for the presence of flatware and other kitchen equipment. It is important to provide an apparatus that allows the discarded valuables to be easily retrieved for the purpose of avoiding the cost of replacement.

Conventionally, in the past, workers have simply taken the refuse from a customer's table and disposed of the refuse in a disposal container. Once the refuse from the table setting has been placed in the disposal container, it is trashed and removed as garbage. As such, if metal flatware, saucers, cups or other articles have been discarded into the disposal container, retrieval is very unlikely. It has been known, in the past, that restaurant owners and managers will require workers to dig through the disposal containers to check for any discarded valuables. This is a very messy, unsanitary and inconvenient procedure. Workers will tend to only take superficial measures in order to try to recover such valuables. If one were able to more easily inspect the discarded refuse prior to disposal, then the opportunity to recover valuables would be greatly enhanced.

In the past, various patents have issued relating to the ability to recover valuable items prior to disposal. For example, U.S. Pat. No. 7,683,779, issued on Mar. 23, 2010 entitled "Flatware Detection Apparatus" by the present inventor, describes an apparatus for preventing workers from inadvertently discarding metal articles. The apparatus includes a base suitable for mounting on an open end of a waste receptacle, a tray pivotally mounted to the base, and a metal detector mounted to the underside of the tray. The metal detector detects the presence of metal articles deposited in the tray amidst food scraps or other waste. The metal detector signals an audible alarm alerting workers to the presence of metal articles in the waste. Once the metal articles are removed, the worker can use a handle or a button system to pivot the tray so as to deposit the food scraps or other waste in the waste receptacle.

U.S. Patent Publication No. 2004/0000904, published on Jan. 1, 2004 to J. E. Cotter, shows an apparatus for detecting metal objects deposited into a trash can. This apparatus includes a driving coil, a receiving coil, and a voltage detector. The driving coil encircles an opening formed in a ring-like lid for the trash can. The controller connects to the driving coil and oscillates a driving current in the driving coil. A receiving coil is disposed parallel to the driving coil and has an current induced therein from the driving current in the driving coil. The voltage detector connects to the coil and detects changes in voltage of the inducted current when a metal object passes through the driving coil and the receiving coil.

U.S. Pat. No. 4,632,253, issued on Dec. 30, 1986 to Stromgren et al., provides an apparatus for separating cutlery from restaurant waste. This apparatus has a hopper that forms a chute and is adapted to be placed above the opening of a waste container. There is a sloping surface in the hopper in which the waste is tipped. There is also an opening at the lower portion of the surface. A flap is arranged in the hopper so as to be pivotable between a pair of positions. There is a first position for closing off the opening and a second position for uncovering the opening. An electrical switching signal from an inductive-type probe controls a drive member for pivoting the flap between the first and second positions. The probe is placed on the underside of the sloping surface.

U.S. Pat. No. 6,833,789, issued on Dec. 21, 2004 to Carmen et al., teaches a waste receptacle-mounted apparatus for scanning of metal objects. The apparatus includes a mounting lip adapted to conform to the top periphery of the waste receptacle and adapted to removably mount to and surround the aperture of the waste receptacle. A funnel-shaped entryway extends from the mounting lip. A plurality of vertical walls extend below the mounting lip and the top periphery of the waste receptacle and are attached to the funnel-shaped entryway so as to form an opening to the waste receptacle. A detector coil surrounds the vertical walls for detecting metal passing through the opening. Control electronics coupled to the detector coil include a speaker and a light indicator for warning that the detector coil has detected metal passing through the opening. A counter displays the number of times the detector coil has detected metal passing through the opening. A gain adjustment is provided for adjusting the sensitivity of the detector coil.

U.S. Pat. No. 6,667,689, issued on Dec. 23, 2003 to Steffen et al., describes a device that easily fits on a waste receptacle and will sound an audible alarm when silverware, that has been magnetized and likely hidden within other refuse, falls through a sensing cavity on its way to the waste receptacle.

This device will not trigger on any other metallic or non-metallic material due to its sensing of only passing magnetic fields. Silverware material conducive to magnetization can be easily magnetized and will retain such characteristics for a long period of time making it a practical way to differentiate silverware from other metallic refuse. The device also uses a sensing switch that activates the same audible alarm when an attempt is made to bypass the unit by removing it from the refuse container. A key switch provides security that enables alarm reset only by authorized personnel. A low battery indicator is provided by the pulsing of the audible alarm.

U.S. Pat. No. 6,222,450, issued on Apr. 24, 2001 to Clements, teaches a support assembly for a metal detection device. The detection device includes a housing with a central orifice, an induction member surrounding the orifice for generating an output voltage when a metal object is passed nearby, and a mechanism which includes pulse-emitting and pulse-receiving members for selectively sensing an object passing through the orifice. The support assembly includes a base member having front, rear and opposed side portions sized and shaped for positioning beneath the housing. The base member has a central aperture adapted for substantial alignment with the housing orifice when the base member is positioned beneath the housing. A mechanism secures the base member to the housing, and a plurality of mounting posts are disposed along the base member front, rear and side portions for positioning a metal detection device induction member about the central aperture. A mounting mechanism is provided for the pulse-emitting and pulse-receiving members on opposite sides of the central aperture. A plurality of pulse-regulating elements are provided for eliminating ambient light interference and cross-pulse sensing.

U.S. Pat. No. 5,797,497, issued on Aug. 25, 1998 to Edwards, describes a device for trapping flatware in food waste prior to entry into a waste receptacle which includes a housing positioned onto the waste receptacle having a downwardly sloping chute, an electronic metal detector disposed in the housing, and a mechanically-operated pivoting door that guards the lower opening of the chute. A spring-loaded mechanical linkage closes the door upon being released by an actuator that is signaled by the metal detector as to when flatware is present. The use of a spring-loaded mechanism to operate the pivoting door minimizes power requirements and is lightweight.

U.S. Pat. No. 4,742,339, issued on May 3, 1988 to Baziuk, teaches a flatware detector device for detecting metal objects discarded as trash along with non-metallic trash material. The detector device includes a metal detecting ring or the like mounted at the top of a waste receptacle, in combination with circuitry adapted to trigger an alarm upon passage of a metal object such flatware into the waste receptacle. A counter may also be provided to count the number of metal objects placed into the waste receptacle.

It is an object of the present invention to provide an apparatus that facilitates the inspection of discarded articles prior to disposal.

It is another object of the present invention to provide an apparatus which prevents flatware, and other kitchen equipment, from being inadvertently discarded.

It is another object of the present invention to provide an apparatus which lowers the operational cost of businesses in the hospitality and restaurant industries.

It is a further object of the present invention to provide an apparatus which fits easily on the top opening of a waste receptacle.

It is a further object of the present invention to provide an apparatus that allows a worker to retrieve valuable objects from food scraps and other refuse before they fall into the opening of a waste receptacle.

It is still another object of the present invention to provide an apparatus that is easily portable.

It is still a further object of the present invention to provide an apparatus that requires little or no maintenance.

It is a further object of the present invention to provide an apparatus that is durable, water-resistant and corrosion-resistant.

It is still a further object of the present invention to provide a latching device that effectively secures a tray in a horizontal position while allowing a handle to release the latch so as to allow the tray to pivot angularly for the purpose of discarding refuse into a waste container.

These and other objects and advantages of the present invention will become apparent from a reading of the attached specification and appended claims.

BRIEF SUMMARY OF THE INVENTION

The present invention is an apparatus for facilitating inspection of discarded items prior to disposal. This apparatus comprises a receptacle suitable for fitting on an opening of a disposal container. A tray is pivotally mounted in the inner opening of the receptacle. The tray is movable between a generally horizontal first position and an angularly disposed second position. The second position is suitable for allowing discarded articles to pass into the container. A handle is connected to the tray and extends radially outwardly therefrom. A latching means is cooperative with the handle for fixing the tray in the first position and for releasing the tray from the first position when a lifting force is applied to the handle.

In the present invention, the receptacle has an outer ring extending downwardly therefrom and at a periphery thereof. This outer ring is suitable for extending around a rim of the disposal container. The receptacle has a wall extending upwardly therefrom. This wall extends around a periphery of the inner opening. The wall has at least one slot formed therein. The handle extends through the slot of this wall.

The tray has a rim extending upwardly around a portion of a periphery thereof. The rim is adjacent the inner opening of the receptacle. In one embodiment, the tray has a plurality of holes formed therein. This plurality of holes is suitable for allowing liquids to drain therethrough.

The tray has a housing positioned at a periphery thererof. The handle is pivotally connected to the housing. The latching means includes a latch member that is positioned in the housing and extends downwardly therefrom. The receptacle has a surface formed adjacent the inner opening. The latch member engages this surface when the tray is in the first position. The latch member releases from the surface when the handle is pivoted with respect to the housing by application of the lifting force. The handle has an arm extending downwardly therefrom. This arm bears on the latch member. The latch member has a structural member slidably positioned in the housing and a latch arm extending downwardly from the structural member. The latch arm has a flange extending outwardly therefrom at an end opposite the structural member. The flange is suitable for engaging the surface of the receptacle. The arm bears against the structural member. A spring is positioned in the housing to bear against a side of the structural member opposite the arm.

The present invention is also a latching apparatus that comprises a handle having an arm extending downwardly therefrom, a housing pivotally connected to the handle, a structural member slidably received in the interior area of the housing such that the handle bears against structural member, and a latch arm extending downwardly from the structural member. The latch arm has a flange formed at an end thereof opposite the structural member. The handle pivots with respect to the housing such that the arm urges on the structural member so as to move the flange of the latch arm inwardly. A spring is positioned in the housing. This spring bears on the structural member on a side opposite the latch arm. The spring urges on the structural member so as to move the flange of the latch arm outwardly. The flange has a tapered surface extending from an outer end thereof toward a bottom of the latch arm.

DETAILED DESCRIPTION OF THE INVENTION

Figure 1:
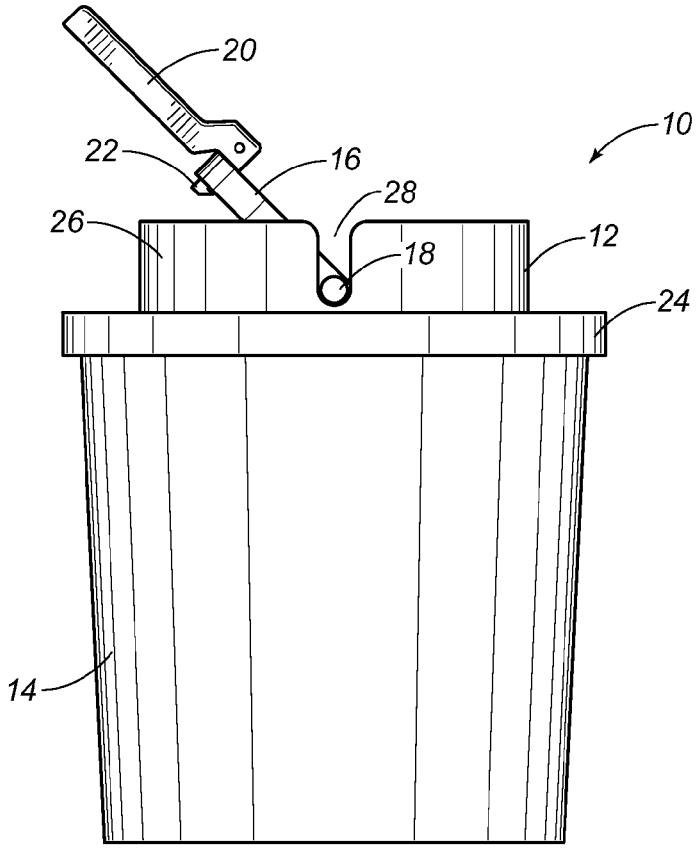
FIG. 1 is a side elevational view of the disposal apparatus in accordance with the preferred embodiment of the present invention.

Referring to FIG. 1, there is shown the disposal apparatus 10 in accordance with the teachings of the present invention. The disposal apparatus 10 includes a receptacle 12 having an inner opening. As can be seen, the receptacle is suitable for fitting over an opening of a disposal container 14. The disposal container 14 can be in the nature of a trash can. A tray 16 is pivotally mounted at pivotal connection 18 within the inner opening of the receptacle 12. The tray 16 has a handle 20 extending radially outwardly of the periphery of the tray 16. A latching means 22 is cooperative with the handle 20 so as to serve to fix the tray 16 within the inner opening of the receptacle 12 and for releasing the tray 16 when a lifting force is applied to the handle 20. This latch 22 will be described in greater detail hereinafter.

In FIG. 1, it can be seen that the receptacle 12 has an outer ring 24 extending downwardly thereof at a periphery of the receptacle 12. The outer ring 24 is suitable for extending around a rim of the disposal container 14. The receptacle 12 also has a wall 26 extending upwardly therefrom. This wall 26 will extend around a periphery of the inner opening. The wall 26 will have at least one slot formed therein. This slot is suitable for allowing the handle 20 to extend therethrough when the tray 16 is positioned over the inner opening of the receptacle 12. The pivotal connection 18 of the tray 16 with the receptacle 12 can be in the nature of an axle. For the purposes of cleaning, there is a slot 28 formed through the wall 26 of the receptacle 12. As such, the axle associated with the pivotal connection 18 can be released from the receptacle 12 such that the tray 16 can be easily removed therefrom.

Figure 2:
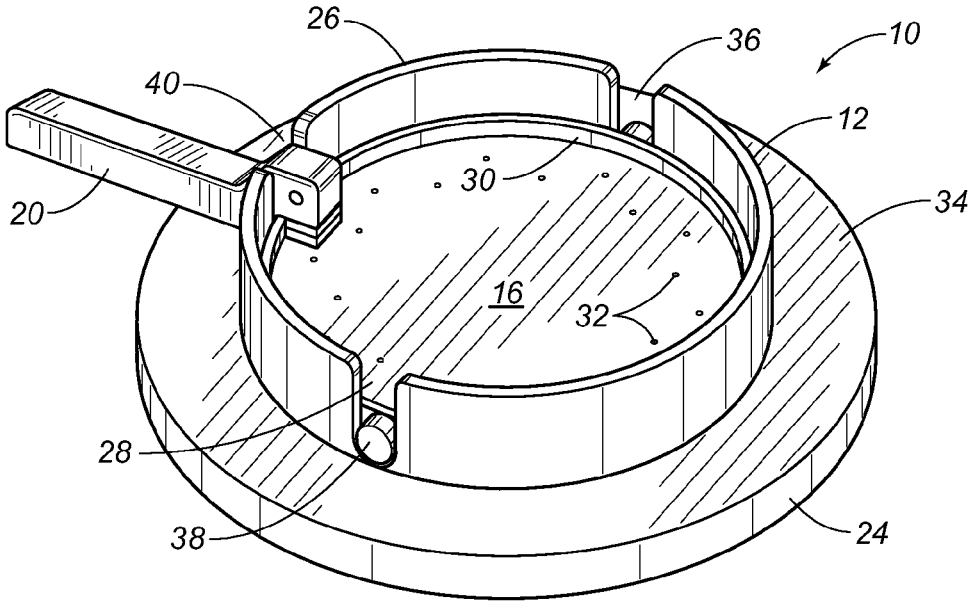
FIG. 2 is an upper plan view of the disposal apparatus of the present invention.

It can be seen in FIG. 1, that the tray 16 is angularly disposed so as to extend upwardly. As such, any trash or food particles residing on the surface of the tray 16 can be released for disposal into the interior of the container 14. The handle 20 can be pushed downwardly such that the latch 22 will engage a surface of the receptacle 12 so as to fix the tray 16 in a generally horizontal position. Additionally, the latch 22 can engage the surface of the receptacle 12 simply by releasing the handle and allowing gravity to retrun the tray 16 to the horizontal position. In this position, food articles, and other materials, can be accumulated on the surface of the tray 16 prior to disposal. FIG. 2 illustrates the tray 16 in this horizontal position.

FIG. 2 shows the receptacle 12 with the tray 16 in a generally horizontal position. The tray 16 has a rim 30 extending upwardly around a periphery thereof. The rim 30 will be adjacent to the wall 26 of the receptacle 12. The tray 16 is illustrated as having a plurality of holes 32 formed therethrough. Holes 32 are suitable for allowing any liquids to drain therethrough and into the container 14.

The wall 26 of the receptacle 12 is illustrated as having the outer ring 24 extending downwardly therefrom. A flat surface 34 extends from the outer ring 24 toward the wall 26. As such, the disposal apparatus 10 of the present invention can be easily adapted to various diameters of the upper rim of the disposal container 14. The wall 26 of the receptacle 12 extends around the outer periphery of the tray 16. Slots 28 and 36 are formed into the wall 26 so as to allow the axle 38 of the tray 16 to be positioned therein. Axle 38 allows from the tray 16 to be pivotally mounted within the receptacle 12 and to be movable in the horizontal (as illustrated in FIG. 2) and the angularly disposed position (as illustrated in FIG. 1).

The handle 20 is affixed to the tray 16 and extends radially outwardly therefrom through a slot 40 formed in the wall 26. It can be seen that the handle 20 is affixed onto the rim of the tray 16. The handle 20 has a portion that extends outwardly beyond the wall 26 so as to allow a user to easily grip the handle 20. When a lifting force is applied to the handle, the tray 16 will become unlatched so that the tray 16 can move to the angularly disposed position (as illustrated in FIG. 1). When the handle 20 is moved downwardly, a latch associated with the handle 20 will engage a surface of the receptacle 12 so as to fix the tray 16 in its generally horizontal orientation. As such, materials can be accumulated on the top surface of the tray 16 prior to release into the interior of the container 14.

Figure 3:
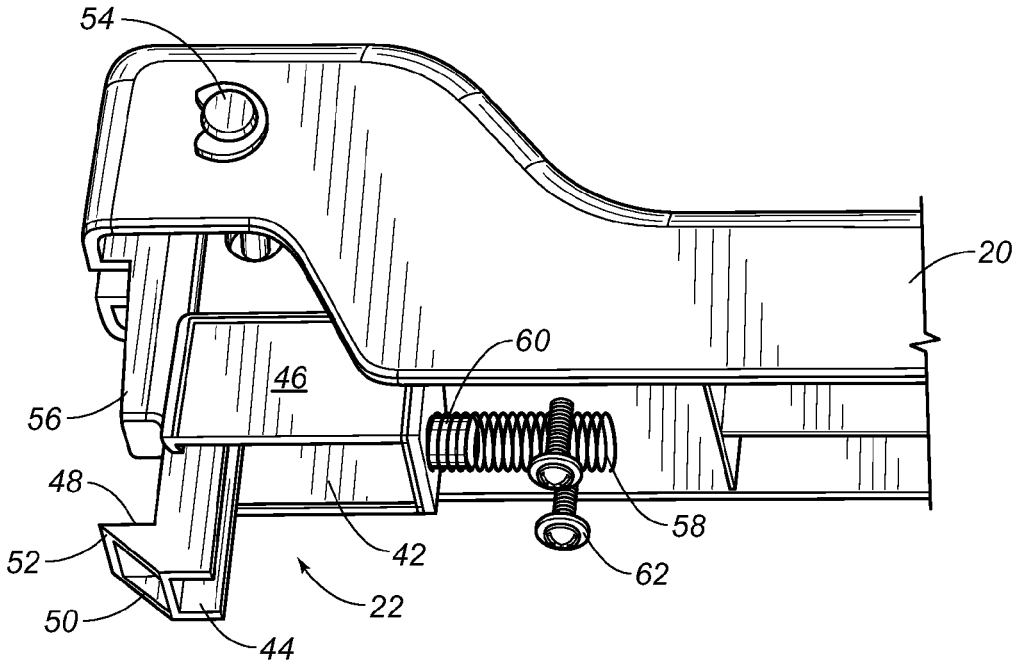
FIG. 3 is a bottom perspective view (with the housing omitted) of the latching mechanism of the present invention.

FIG. 3 shows the handle 20 along with the latching mechanism 22. The housing associated with the latching mechanism 22 is removed in FIG. 3 for purposes of illustration. The handle 20 has the latch member 42 positioned within the housing (not illustrated) and slidably received therein. A latch arm 44 is connected to a structural member 46 of the latch member 42. The structural member 46 is of a box shape. The latch arm 44 has an arm vertically downwardly therefrom with a flange extending outwardly from an end of the latch arm 44 opposite the structural member 46. A tapered surface 50 extends from the outer edge 52 of the flange 48 so as to extend angularly downwardly to the end of the latch arm 44. This tapered surface 50 will allow the latch arm 44 to be easily secured to the latching surface of the receptacle 12.

The handle 20 includes a pivotal connection 54 formed therethrough. Pivotal connection 54 can be secured to the housing (not shown) so as to allow the handle 20 to pivot with respect to the housing. An arm 56 extends downwardly from the end of the handle 50 so as to have a surface bearing upon the structural member 46. A spring 58 is affixed to a pin member 60 on the opposite side of the structural member 46 from the arm 56. Spring resiliently bears against the structural member 46 so as to urge the structural member 46 toward the arm 56. The pivotal movement of the arm 20 about the pivotal connection 54 will cause the arm 56 to overcome the resistance of the spring 58 so urge the structural member 46 inwardly and to release the latch arm 44 from its engagement with the surface of the receptacle 12. Fasteners 62 are illustrated in FIG. 3 in a position suitable for engaging with the housing.

Figure 4:
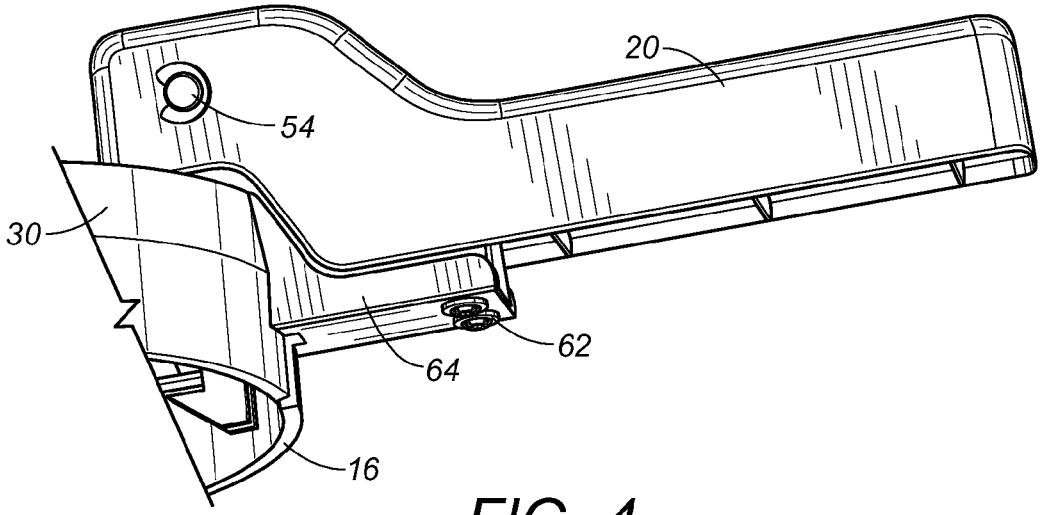
FIG. 4 is a bottom perspective view showing the mounting of the handle with respect to the housing.

FIG. 4 illustrates the handle 20 as pivotally connected at pivotal connection 54 with the housing 64. The housing 64 is securely mounted to the outer rim 30 of the tray 16. Fasteners 62 secure the housing 64 within a channel formed on the interior of the handle 20. As such, it can be seen that the handle 20, when lifted, will serve to pull the housing 64, along with the tray 16, angularly upwardly about the axle 38.

Figure 5:
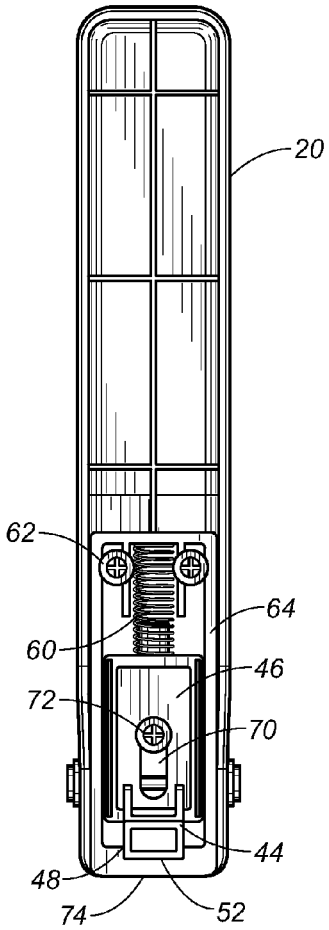
FIG. 5 is a bottom view of the latching mechanism of the present invention.

FIG. 5 shows the interior of the handle 20. In particular, it can be seen that the housing 64 is secured by fasteners 62 to the handle 20. The housing 64 has a channel on the interior thereof. The box-shape structural member 46 is slidably received within the housing 64 so as to have outer walls positioned generally adjacent to the inner walls of the housing 64. The spring 58 has one end abutted against the housing 64 and another end positioned over the pin member 60 extending outwardly of the structural member 46. There is a slot 70 formed in the bottom of the structural member 46. A screw or bolt 72 is engaged with the housing 64 and slidably received within the slot 70. As such, the slot 70 will define a movement of the structural member 46, along with the latch arm 44. The latch arm 44 is illustrated as having the outer edge 52 of the flange 48 extending outwardly toward the end 74 of the handle 20.

Figure 6:
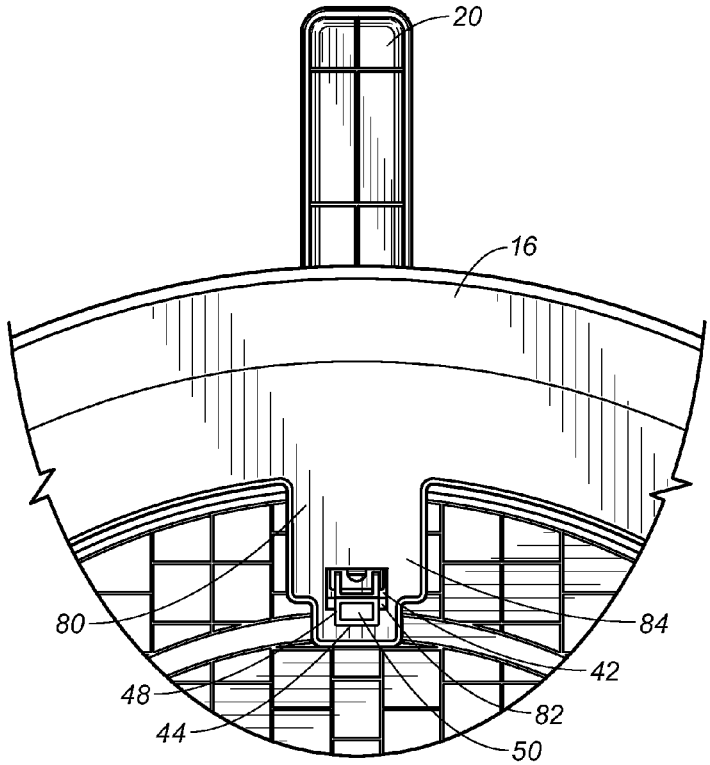
FIG. 6 is a bottom view of the receptacle showing the engagement of the latching mechanism with the receptacle.

FIG. 6 illustrates how the handle 20 has the flange 48 engaged with a surface 80 of the receptacle 12. A channel 82 is formed in outwardly extending strut 84 at the bottom of the receptacle 12. When the handle 20 is pushed downwardly, the tapered surface 50 of the latch arm 44 will cause the flange 48 of the latch number 42 to pass through slot 82 and to engage the surface 80 of the strut 84. As such, the tray 16 will be fixed in a generally horizontal orientation. When the handle 20 is lifted upwardly, the arm 56 will urge against the structural member 46 so as to cause the flange 48 to move downwardly and to be released through the channel 82. As such, the tray 16 is able to be pivoted to its angularly extended position for the release of articles into the container 14.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus for inspecting discarded items prior to disposal comprising:

a receptacle having an inner opening, said receptacle suitable for fitting on an opening of a disposal container;

a tray mounted by a pivotal connection in said inner opening of said receptacle, said tray movable between a horizontal first position and an angularly disposed second position, said second position suitable for allowing discarded articles to pass from said tray into the container, said tray having a first portion on one side of said pivotal connection extending angularly upwardly and a second portion on an opposite side of said pivotal connection extending angularly downwardly when in the second position, said first portion and said second portion being coplanar;

a handle connected to said tray and extending radially outwardly therefrom; and a latching means cooperative with said handle for fixing said tray in said first position and releasing said tray from said first position when a lifting force is applied to said handle, said receptacle having a wall extending upwardly therefrom, said wall extending around a periphery of said inner opening, said wall having at least one slot formed therein, said handle extending through the slot of said wall.

2. The apparatus of claim 1, said receptacle having an outer ring extending downwardly therefrom at a periphery of said receptacle, said outer ring suitable for extending around a rim of the disposal container.

3. An apparatus for inspecting discarded items prior to disposal comprising:

a receptacle having an inner opening, said receptacle suitable for fitting on an opening of a disposal container;

a tray mounted by a pivotal connection in said inner opening of said receptacle, said tray movable between a horizontal first position and an angularly disposed second position, said second position suitable for allowing discarded articles to pass into the container, said tray having a first portion on one side of said pivotal connection extending angularly upwardly and a second portion on an opposite side of said pivotal connection extending angularly downwardly when in the second position, said first portion and said second portion being coplanar;

a handle connected to said tray and extending radially outwardly therefrom; and a latching means cooperative with said handle for fixing said tray in said first position and releasing said tray from said first position when a lifting force is applied to said handle, said tray having a rim extend upwardly around a portion of a periphery thereof, said rim being adjacent said inner opening of said receptacle.

4. The apparatus of claim 3, said tray having a plurality of holes formed therein, said plurality of holes suitable for allowing liquids to drain therethrough.

5. An apparatus for inspecting discarded items prior to disposal comprising:

a receptacle having an inner opening, said receptacle suitable for fitting on an opening of a disposal container;

a tray mounted by a pivotal connection in said inner opening of said receptacle, said tray movable between a horizontal first position and an angularly disposed second position, said second position suitable for allowing discarded articles to pass from said tray into the container, said tray having a first portion on one side of said pivotal connection extending angularly upwardly and a second portion on an opposite side of said pivotal connection extending angularly downwardly when in the second position, said first portion and said second portion being coplanar;

a handle connected to said tray and extending radially outwardly therefrom; and a latching means cooperative with said handle for fixing said tray in said first position and releasing said tray from said first position when a lifting force is applied to said handle, said tray having a housing positioned at a periphery thererof, said handle being pivotally connected to said housing, said latching means comprising a latch member positioned in said housing and positioned downwardly therefrom, said receptacle having a surface formed adjacent said inner opening, said latch member engaging said surface when said tray is in said first position.

6. The apparatus of claim 5, said latch member releasing from said surface when said handle is pivoted with respect to said housing by application of the lifting force.

7. The apparatus of claim 6, said handle having an arm extending downwardly therefrom, said arm bearing on said latch member.

8. The apparatus of claim 7, said latch member comprising:

a structural member slidably positioned in said housing; and a latch arm extending downwardly from said structural member, said latch arm having a flange extending outwardly therefrom at an end opposite said structural member, said flange suitable for engaging said surface.

9. The apparatus of claim 8, said arm bearing against said structural member, said latch member further comprising:

a spring positioned in said housing so as to bear against a side of said structural member opposite said arm.

10. A latching apparatus comprising:

a handle having an arm extending downwardly therefrom;

a housing pivotally connected to said handle, said housing having an interior area;

a structural member slidably received in said interior area of said housing, said arm of said handle bearing against said structural member; and a latch arm extending downwardly from said structural member, said latch arm having a flange formed at an end thereof opposite said structural member, said handle pivoting with respect to said housing such that said arm urges on said structural member so as to move said flange of said latch arm inwardly.

11. The latching apparatus of claim 10, further comprising:

a spring positioned in said housing, said spring bearing on said structural member on a side opposite said latch arm, said spring urging on said structural member so as to move said flange of said latch arm outwardly.

12. The latching apparatus of claim 10, said flange having a tapered surface extending from an outer end thereof toward a bottom of said latch arm.

13. The latching apparatus of claim 10, further comprising:

a tray having an outer peripheral surface, said housing being affixed to said outer peripheral surface and extending radially outwardly therefrom, said handle having a portion extending radially outwardly of said tray.

14. The latching apparatus of claim 10, said housing having a channel formed therein, said structural member having a box shape with walls positioned adjacent inner walls of said channel.

15. The latching apparatus of claim 11, said structural member having a pin member extending outwardly therefrom on a side opposite said latch arm, said pin member receiving an end of said spring thereon.

* * * * *